United States Patent [19]

Krempp

[11] 3,997,204

[45] Dec. 14, 1976

[54] LATCHING STRUCTURE

[75] Inventor: Stanley G. Krempp, Jasper, Ind.

[73] Assignee: The United Cabinet Corporation, Jasper, Ind.

[22] Filed: Jan. 23, 1975

[21] Appl. No.: 543,261

[52] U.S. Cl. ..... 292/288; 292/162

[51] Int. Cl.[2] ..... E05C 1/04

[58] Field of Search ..... 292/288, 175, 145–154, 292/162, 300

[56] References Cited

UNITED STATES PATENTS

| | | | |
|---|---|---|---|
| 1,176,457 | 3/1916 | Jones | 292/288 |
| 3,620,483 | 11/1971 | Weinberger | 292/288 |
| 3,785,685 | 1/1974 | MacDonald et al. | 292/288 |

*Primary Examiner*—Richard E. Moore
*Attorney, Agent, or Firm*—Warren D. Flackbert

[57] ABSTRACT

A latching structure characterized as a member having a portion slideable along an edge of a hinged cabinet door, where, when in a fully operative or latching position, another portion thereof engages the frame surrounding the door opening, whereby the door remains in a closed position during transporting and installation to prevent unwanted opening and damage.

3 Claims, 7 Drawing Figures

LATCHING STRUCTURE

As is known, various approaches have been in use heretofore to prevent any unwanted opening of a door, as for furniture or built-in cabinets, during transporting and subsequent installation in the instance of the latter. It has been desirous to have an economical and yet more effective approach for overcoming the aforesaid difficulty which oftentimes occasions damage to the door, as scratching, possible misalignment or the like. As a solution, the invention provides a simple yet positive arrangement for holding a door in a closed positon, such not being dependent upon various latching arrangements which might be subsequently involved after the cabinet has been positioned.

In any event, and broadly, the invention is in the form of a latching clip having one portion fitting in a snapped relationship over the edge of a cabinet door, and, integral therewith, another portion designed to selectively engage the frame surrounding the cabinet door in a fastened relationship. In order to accomplish the preceding, the latching structure is slideable along the edge of the door from a non-locked position to a retaining or latching position. The retaining position is comparable to a jaw-like cooperating grasp by the latching structure with the frame.

The invention may assume different forms, basically involving the same sliding and locking relationship, depending upon location of use. Moreover, while described herein in connection with a door, the invention could be adaptable to use in other latching functions, as with a drawer, for example.

A better understanding of the present invention will become more apparent from the following description, taking in conjunction with the accompanying drawing, wherein FIG. 1 is a view in front elevation, partly fragmentary, showing the latching structure of the invention in an operative or latched position;

Figure 3:
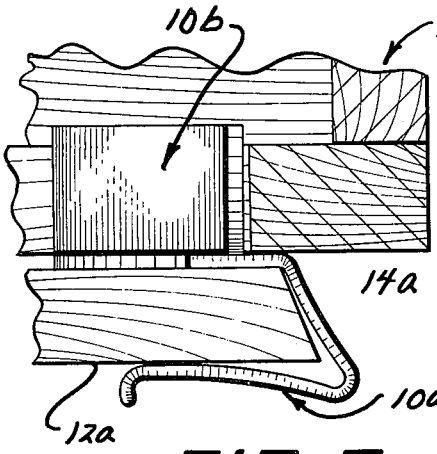
FIG. 3 is a view in end elevation, looking from left to right in FIG. 2, showing further details of use of the invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, a latching structure 10 is disclosed, which, in a preferred form, may be made from a plastic resin, or, at least, a material capable of flexing or resiliency. While two usages of the invention are illustrated, bearing the same reference numerals, only one will be described herein, in that such are substantially identical, one usage being in connection with an upper edge of a door, while the other usage being in connection with a lower edge of a door.

Figure 5:
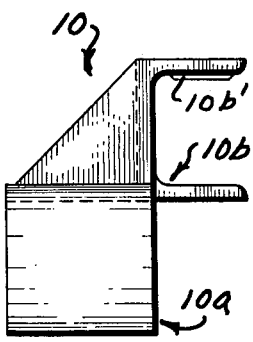
FIG. 5 is a view of the latching structure of the invention, comparing to that of FIG. 2, but without surrounding environment.
Figure 6:
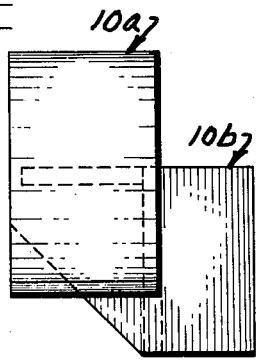
FIG. 6 is another detailed view of the instant latching structure, comparing to that of FIG. 1; and, FIG. 7 is a further detailed view of the instant latching structure, comparing to that of FIG. 3.
Figure 7:
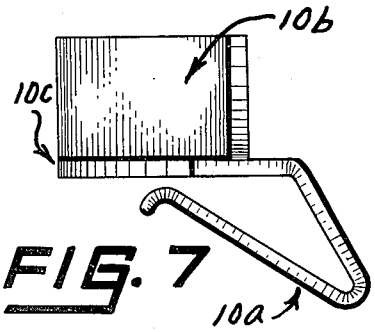

FIGS. 5, 6 and 7 show the latching structure defining the invention from various views, where such is unitary and comprises a gripping portion 10*a* for resiliently engaging an edge 12*a* of a door 12; a latching portion 10*b*, extending outwardly in jaw-like fashion, for selectively confining a part 14*a* of the frame 14 surrounding the door 12 opening; and, an interconnecting body portion 10*c*.

Figure 2:
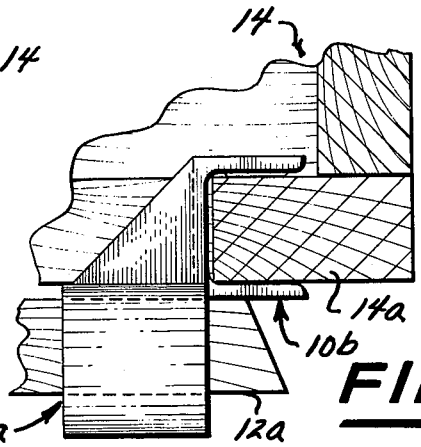
FIG. 2 is a fragmentary top plan view showing the aforesaid latched position, looking downward onto FIG. 1.
Figure 1:
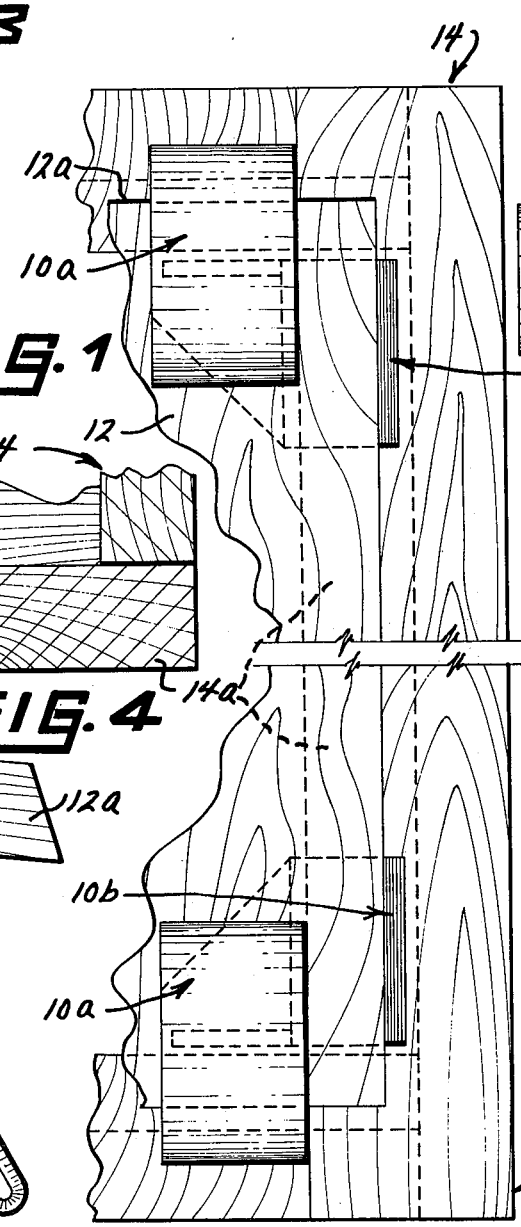
Figure 4:
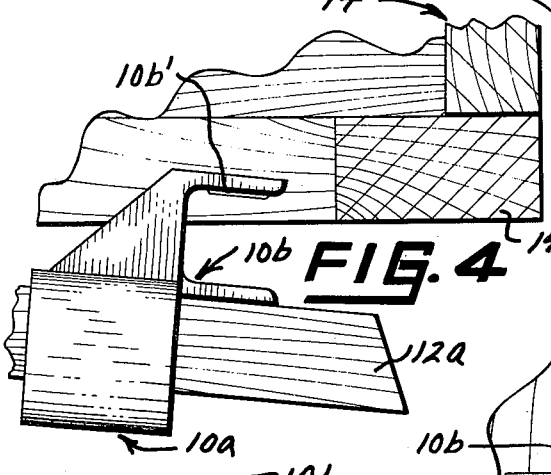
FIG. 4 is a top plan view, generally comparing to the illustration of FIG. 2, but showing the latching structure prior to sliding into the latched position of FIGS. 1 and 2.

As apparent from FIGS. 2 and 3, the gripping portion 10*a* readily slips over the edge 12*a* of the cabinet door 12, and as further apparent from FIGS. 4 and 2, the overall latching structure 10 is movable from a non-latching position (FIG. 4) to a latching or latched position (FIG. 2). In the aforesaid latched position, and as stated, the jaw-like latching portion 10*b* partly surrounds part 14*a* of the frame 14 for the door 12 opening.

Moreover, it might be noted that in a preferred form of the invention, the latching portion 10*b* includes one or more raised ribs 10*b'* along an inner surface of the jaws thereof for purposes of positive retaining action.

Further, as to the latching structure on the bottom edge of the door 12, such includes the same basic arrangement as described hereabove, but modified for reasons of placement geometry. Thus, from the preceding, it should be apparent that the invention provides a simple and effective interlocking relationship between a hinged door and the framework surrounding the latter, preventing any undesired opening of the door while the cabinet or like unit is being transported and/or installed. Positive selective latching is provided, virtually eleminating any likelihood of unit damage which oftentimes was the result of approaches in use heretofore.

In any event, the latching structure of the invention is susceptible to various changes, as for example, in proportioning, the location thereof on the unit and the like. Accordingly, the above description should be considered illustrative and not as limiting the scope of the following claims.

I claim:

1. A latching structure selectively interconnecting a door and a doorframe comprising a first portion slideably received on an edge of said door and movable along said edge from a non-latching position to a latching position when said door is closed, and a second portion extending in the direction of movement of the latching structure along said edge grasping an edge of said doorframe when said first portion is at said latching position.

2. The latching structure of claim 1 where said second portion has extending jaws between which said edge of said doorframe is received.

3. The latching structure of claim 2 where one of said jaws includes a raised rib on an inner surface thereof.

* * * * *